US007501722B2

(12) United States Patent
Shitanaka et al.

(10) Patent No.: US 7,501,722 B2
(45) Date of Patent: Mar. 10, 2009

(54) ILLUMINATED SWITCH DEVICE

(75) Inventors: Hitokazu Shitanaka, Fukui (JP); Masaki Kontani, Fukui (JP)

(73) Assignee: Panasonic Corporation, Osaka (JP)

( * ) Notice: Subject to any disclaimer, the term of this patent is extended or adjusted under 35 U.S.C. 154(b) by 0 days.

(21) Appl. No.: 11/703,252

(22) Filed: Feb. 7, 2007

(65) Prior Publication Data

US 2007/0188024 A1 Aug. 16, 2007

(30) Foreign Application Priority Data

Feb. 10, 2006 (JP) ..... 2006-033376

(51) Int. Cl.
*G09F 9/00* (2006.01)
*G09F 9/40* (2006.01)

(52) U.S. Cl. ..... 307/112; 116/284; 116/286; 116/318

(58) Field of Classification Search ..... 307/112
See application file for complete search history.

(56) References Cited

U.S. PATENT DOCUMENTS 4,354,077 A * 10/1982 McMains et al. ..... 200/314
4,357,511 A * 11/1982 Tenner et al. ..... 200/314
4,549,050 A * 10/1985 Lang ..... 200/314
5,736,697 A * 4/1998 Fuller et al. ..... 200/5 R
5,905,238 A * 5/1999 Hung ..... 200/314
6,178,916 B1 * 1/2001 Snider ..... 116/284
6,627,829 B2 * 9/2003 Sato ..... 200/310
6,733,146 B1 * 5/2004 Vastano ..... 362/23
7,105,759 B1 * 9/2006 Mucha ..... 200/310
7,202,429 B2 * 4/2007 Bouvier et al. ..... 200/310
7,222,979 B1 * 5/2007 Popowich et al. ..... 362/26
7,253,369 B2 * 8/2007 Fu et al. ..... 200/310
7,255,061 B2 * 8/2007 Denton ..... 116/310
2006/0139907 A1 * 6/2006 Yen ..... 362/85
2007/0272524 A1 * 11/2007 Girke et al. ..... 200/11 DA

FOREIGN PATENT DOCUMENTS

JP 2005-216798 8/2005

* cited by examiner

*Primary Examiner*—Stephen W Jackson
*Assistant Examiner*—Adi Amrany
(74) *Attorney, Agent, or Firm*—Wenderoth, Lind & Ponack, L.L.P.

(57) ABSTRACT

A switch device includes a substantially disk-shaped operator; a substantially ring-shaped indicator provided between the operator and the light emitting elements disposed below the operator; and a visible portion formed in the center of an inner periphery of the operator. Since the indicator carrying indications of equipment functions in characters, symbols, figures or the like is formed separately from the operator, the indications will never turn sideways or upside down owing to the rotation of the operator.

17 Claims, 5 Drawing Sheets

ILLUMINATED SWITCH DEVICE

FIELD OF THE INVENTION

The present invention relates to a switch device chiefly used to operate an air-conditioner, audio equipment or the like in a vehicle and an input device using the same.

BACKGROUND OF THE INVENTION

In recent years, a growing number of vehicles have been equipped with a lighted switch device, disposed on a front panel in a vehicle interior, with various styles of operators to operate various kinds of electronic equipment such as air-conditioner or audio equipment. Japanese Patent Unexamined Publication No. 2005-216798 discloses such a lighted switch device.

A conventional switch device and an input device using the same are described with reference to FIGS. 4 and 5. FIG. 4 shows a cross-sectional view of the conventional switch device and the input device using the same, and FIG. 5 shows an exploded perspective view of the conventional switch device and the input device using the same. The input device using the conventional switch device includes a substantially disk-shaped operator 210 formed from an insulating resin and indications 220 as shown in FIGS. 4 and 5. On the top surface of operator 210, indications 220 are applied by laser machining, co-injection molding or the like so as to expose predetermined forms of characters, symbols, figures or the like on a transparent or light colored translucent portion 212 surrounded by opaque portion 211 colored in black or the like.

Switch-element 230 with an upward projecting operation axis 231 includes a plurality of contacts (not shown) internally to perform electrical switching by rotating or vertical moving of operation axis 231. Operation axis 231 is fixed into cylindrical projection 213 projecting from the bottom surface of operator 210.

Wiring board 240 having a plurality of wiring patterns (not shown) on its top and bottom surfaces and substantially box-shaped case 250 formed from an insulating resin form the switch device. Case 250 covers switch-element 230 and light emitting elements 260 such as light emitting diodes mounted on the top surface of wiring board 240, and operator 210 projects rotatably and movably vertically out of cylindrical opening 251 formed in the center of case 250.

Controller 270 is formed on the top surface of wiring board 240 using electronic components such as micro-computers. Switch-element 230 and light emitting elements 260 are connected to controller 270 via the wiring patterns to form a conventional input device.

Such a conventional input device has been installed on the front panel or the like in a vehicle interior and controller 270 is connected electrically to various kinds of electronic equipment such as an air-conditioner or audio equipment and vehicle electronic circuits (not shown) via connectors or lead wires (not shown).

In the above configuration, upon rotating operator 210 clockwise or counter-clockwise, operation axis 231 fixed on the bottom surface of operator 210 rotates together to perform electrical switching of contacts in switch-element 230, thereby transmitting the signals from controller 270 to electronic devices or electronic circuits to control for instance the air-conditioning temperature.

Upon pressing operator 210 downward, operation axis 231 is pressed to perform electrical switching of contacts in switch-element 230, thereby changing the temperature setting mode for air-conditioning from automatic to manual.

Moreover, light emitting elements 260 turn on in a case when it is dark such as at night to illuminate operator 210 from below. Since the light past translucent portion 212 illuminates indications 220 on the upper surface, characters, symbols, figures or the like on indications 220 become visible so that operator 210 can be identified and operated easily even in the case when it is dark.

Namely, the switch device can operate various functions of electronic equipment such as an air-conditioner by rotating or pressing downward operator 210 and can perform the operation easily with the aid of illuminated indications 220 on operator 210 even when it is dark.

As described above, however, since indications 220 in characters, symbols, figures or the like are formed integrally on the top surface of operator 210 in the input device using the conventional switch device, indications 220 rotate together with the rotation of operator 210, causing the indications to turn sideways or upside down. The problem is, therefore, that it is difficult for a driver to view the indications until he/she becomes accustomed to the operation, which can cause operational errors.

SUMMARY OF THE INVENTION

The switch device disclosed in the present invention comprises: a substantially disk-shaped operator; contacts to perform electrical switching by rotating of an operation axis fixed on the bottom surface of the operator; and light emitting elements to illuminate the operator from below, wherein a substantially ring-shaped indicator is provided between the operator and the light emitting elements, and a visible portion is formed in the center of the operator.

Since the indicator carrying indications in characters, symbols, figures or the like to show equipment functions is formed separately from the operator, the configuration can provide a switch device that is easy to view and operate instead of one in which the indications are turned sideways or upside down upon rotating by an operator.

The input device disclosed in the present invention comprises: the switch device; and a controller connected to contacts of the switch device and light emitting elements, wherein the controller turns on-off the light emitting elements according to electrical switching of the contacts of the switch device.

The configuration can realize an input device that is easy to view and operate.

DETAILED DESCRIPTION OF THE INVENTION

An exemplary embodiment of the present invention is described next with reference to the drawings.

Figure 1:
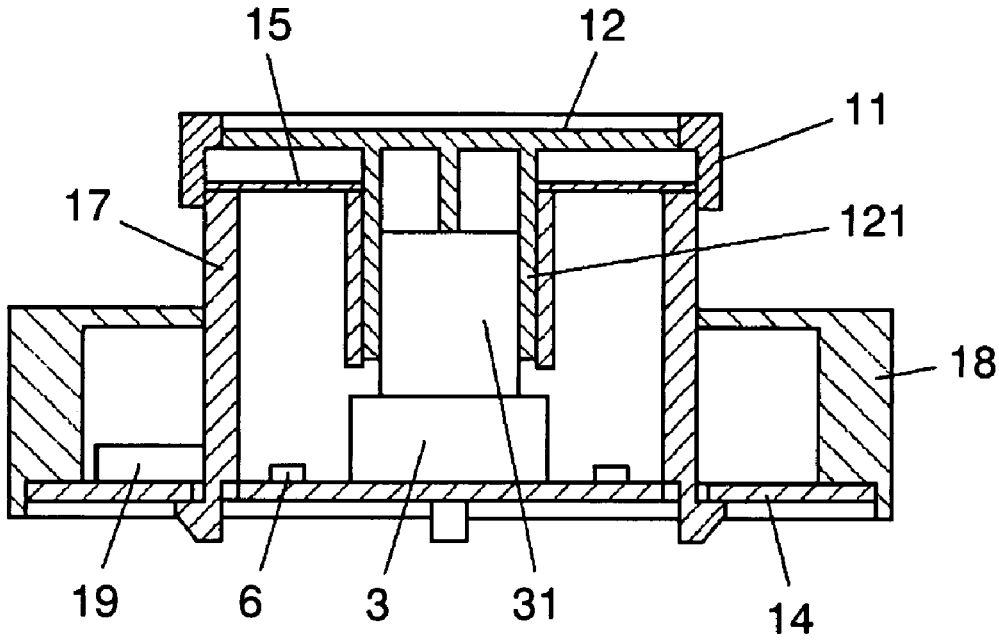
FIG. 1 shows a cross-sectional view of a switch device and an input device using the same in accordance with an exemplary embodiment of the present invention.
Figure 2:
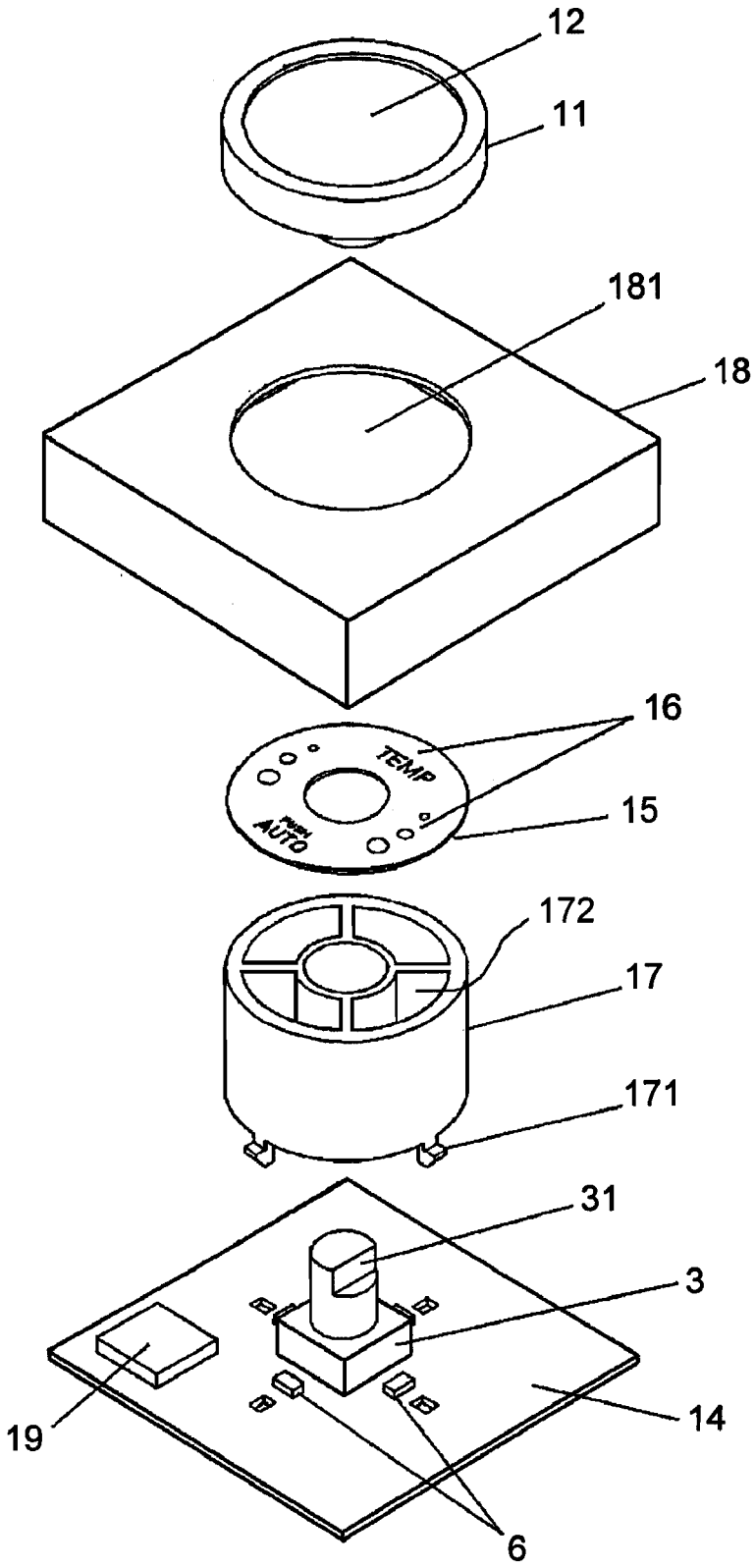
FIG. 2 shows an exploded perspective view of the switch device and the input device using the same in accordance with the exemplary embodiment of the present invention.

FIG. 1 shows a cross-sectional view of a switch device and an input device using the same in accordance with an exemplary embodiment of the present invention, and FIG. 2 shows an exploded perspective view of the switch device and the input device shown in FIG. 1. The input device using the switch device, as shown in FIGS. 1 and 2, includes substantially disk-shaped operator 11 formed from opaque insulating resin, such as acrylic resin or polycarbonate resin, colored in black or the like. A translucent smoky visible portion 12, though dark colored such as in black or brown, is formed in the center of an inner periphery of operator 11. Operator 11 and visible portion (viewing portion) 12 are formed integrally by co-injection molding or the like.

Switch-element 3 with an upward projecting operation axis 31 includes a plurality of contacts (not shown) internally to perform electrical switching by rotating or vertical moving of operation axis 31. Operation axis 31 is secured into cylinder 121 projecting from the bottom surface of operator 11.

On the top and bottom surfaces of wiring board 14 formed from phenolic paper, glass-reinforced epoxy or the like, a plurality of wiring patterns (not shown) are formed by using copper foil or the like, and switch-element 3 and a plurality of light emitting elements 6 such as LEDs are mounted on the top surface of wiring board 14.

On substantially ring-shaped indicator 15 formed from insulating resin, a plurality of indications 16 in characters, symbols, figures or the like are applied on the top or bottom surface of the translucent material and colored in transparent, light color or the like, leaving the other area opaque in black or the like.

Substantially cylindrical cover 17 formed from insulating resin such as ABS resin or polyoxymethylene resin is secured on wiring board 14 by using hooks 171 provided on the bottom surface and indicator 15 is attached on the top of cover 17 so that indicator 15 is disposed between operator 11 and light emitting elements 6. That is, light emitting elements 6 are disposed so as to illuminate operator 11 from below. As shown in FIG. 2, cover 17 includes partitions 172 between adjacent ones of the light emitting elements 6.

Substantially box-shaped case 18 formed from insulating resin is provided to cover the top surface of wiring board 14, allowing cover 17 to pass through opening 181 in the center of case 18, and operator 11 to fix on the top surface of cover 17 rotatably and vertically movably to complete the switch device configuration.

Controller 19 composed of electronic components such as micro-computers is provided on the top surface of wiring board 14. The contacts inside switch-element 3 or light emitting elements 6 are connected to controller 19 via wiring patterns to complete the input device configuration.

Such an input device is installed on a front panel or the like in a vehicle interior and controller 19 is connected electrically to various kinds of electronic equipment such as an air-conditioner or audio equipment and vehicle electronic circuits (not shown) via connectors or lead wires (not shown).

In the above configuration, rotating operator 11 clockwise or counter-clockwise will rotate operation axis 31 fixed on the bottom surface of operator 11 to perform electrical switching of contacts in switch-element 3. Controller 19 turns on-off light emitting elements 6 according to electrical switching of the contacts. The signals will be output from controller 19 to electronic devices or electronic circuits in order to for instance raise or lower the air-conditioning temperature.

Pressing operator 11 downward will press operation axis 31 down to perform electrical switching of contacts in switch-element 3, allowing controller 19 to change for instance a temperature setting mode of air-conditioning from automatic to manual.

Moreover, light emitting elements 6 turn on in a case when it is dark such as at night and the light past cover 17 illuminates indicator 15 from below. Therefore, indications 16 in characters, symbols, figures or the like can be identified clearly through visible portion 12 of operator 11. Consequently, a driver can identify and operate operator 11 easily even when it is dark.

Additionally, since indicator 15 carrying indications in characters, symbols, figures or the like to show equipment functions is attached on the top of cover 17 separately from operator 11, the indications will never turn sideways or upside down in the rotation of operator 11, and will be identified easily without any operational error.

Since visible portion 12 provided in the center of the inner periphery of operator 11 is formed in a translucent smoky dark color, the switch device can perform a wide variety of illuminating modes such that indications 16 on indicator 15 below operator 11 can be made difficult to identify from above when it is light and no illumination of light emitting elements 6, and indications 16 can be identified clearly only when light emitting elements 6 turn on for illumination.

Figure 3A:
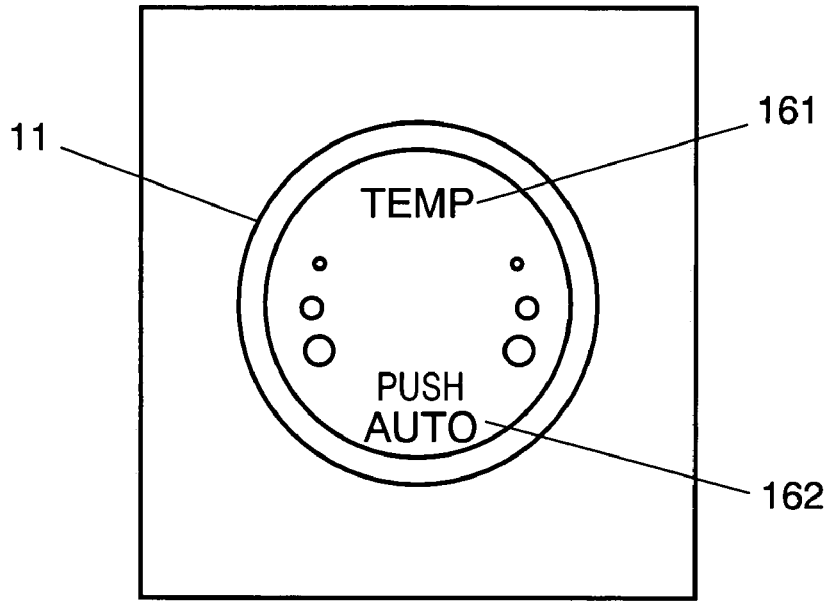
FIG. 3A shows a plan view of the switch device and the input device using the same in accordance with the exemplary embodiment of the present invention.

Also upon pressing operator 11, if controller 19 is set for instance, as shown in the plan view in FIG. 3A, to turn always-on the upper side indications 161 and to turn off the downside indications 162 when the air-conditioning temperature is in an automatic mode according to electrical switching of switch-element 3, and to turn on downside indications 162 when the mode is changed to a manual mode by pressing down operator 11, whether the air-conditioning is controlled automatically or manually can be recognized easily and the configuration will be able to perform a wider variety of operations more easily.

Figure 3B:
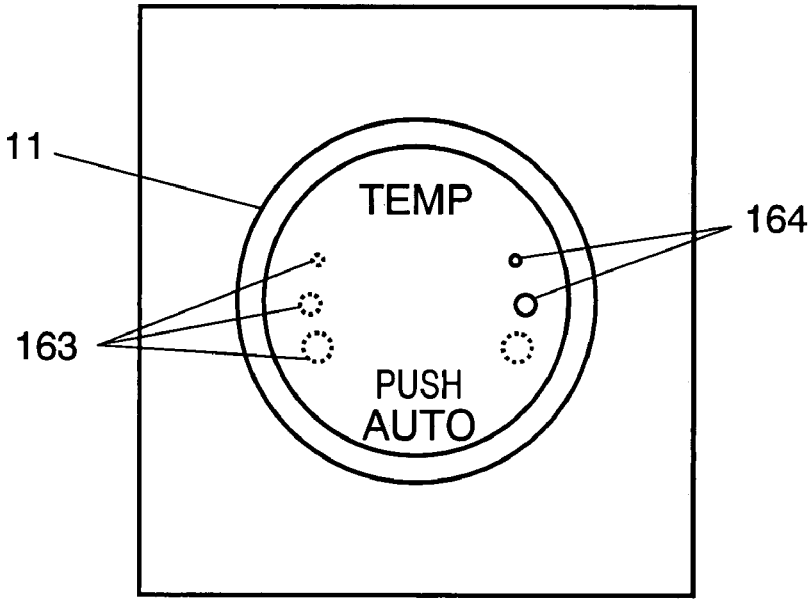
FIG. 3B shows a plan view of the switch device and the input device using the same in accordance with the exemplary embodiment of the present invention.
Figure 4:
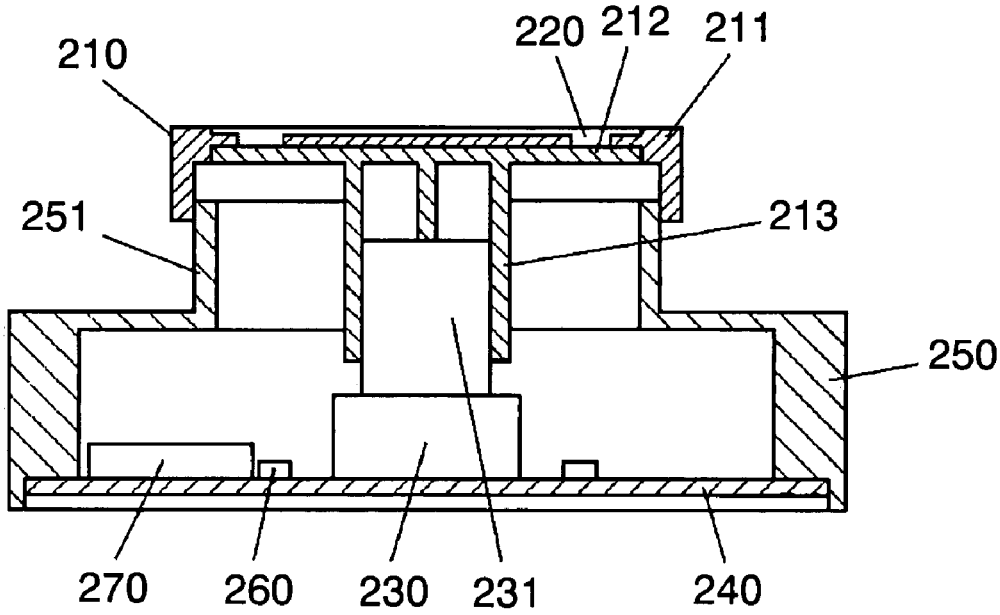
FIG. 4 PRIOR ART
FIG. 4 shows a cross-sectional view of a conventional switch device and an input device using the same.
Figure 5:
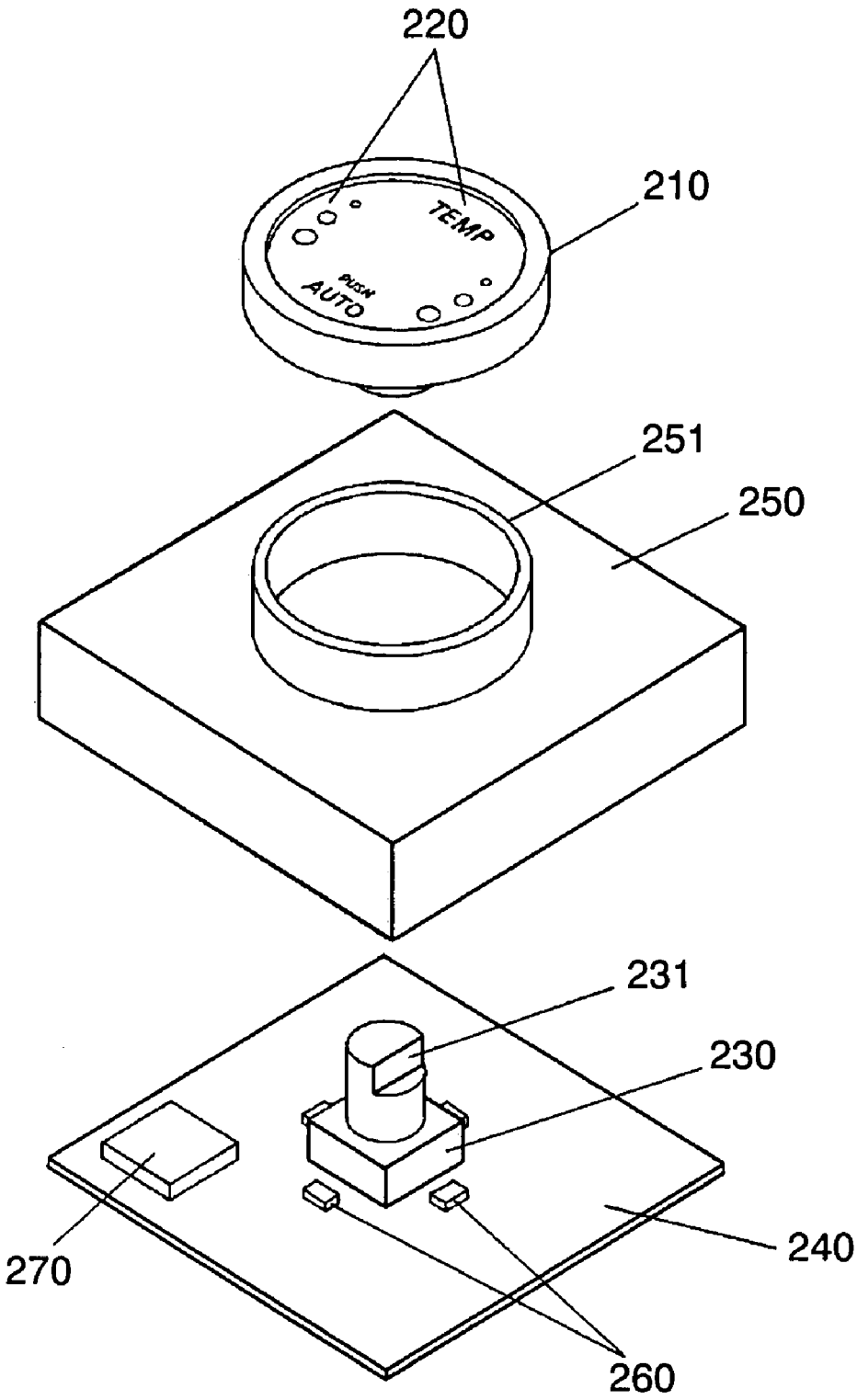
FIG. 5 PRIOR ART
FIG. 5 shows an exploded perspective view of the conventional switch device and the input device using the same.

Moreover, if light emitting elements 6 corresponding to the number and color of respective indications are disposed on wiring board below right-and-left indications 163 and 164, and controller 19 is set, for instance to raise the air-conditioning temperature, as shown in FIG. 3B, to turn off left-hand side cold color indications 163 and to turn on right-hand side warm color indications 164 corresponding to the amount of the rotation by rotating operator 11 clockwise or counter-clockwise, the degree to which the switch device has operated to raise the temperature can be recognized at once and the configuration will be able to perform an easier operation.

As described above in the exemplary embodiment, the switch device disclosed includes: substantially disk-shaped operator 11; substantially ring-shaped indicator 15 provided between operator 11 and light emitting elements 6 disposed below operator 11; and visible portion 12 formed in the center of the inner periphery of operator 11. Since indicator 15 carrying characters, symbols, figures or the like to indicate equipment functions is formed separately from operator 11, the indications on indicator 15 will never turn sideways or upside down in the rotation of operator 11. The present invention, therefore, can provide the switch device that is easy to view and operate.

Since visible portion 12 on operator 11 is formed in a translucent smoky dark color, the switch device can perform a wide variety of illuminating modes such that the indications become difficult to view when it is light and become visible clearly only when indicator 15 is illuminated.

The input device that is easy to view and operate with a wide variety of applications can be realized by connecting controller 19 to the switch device to turn on-off light emitting elements 6 according to electrical switching of the contacts of the switch device.

In the above configuration, switch-element 3 with substantially cylindrical operation axis 31 projecting upward in the center is described for electrical switching by rotating and vertical moving of operator 11, but a large diameter hollow cylinder can replace operation axis 31 or a combination of rotary switch and pressing switch can be acceptable to realize the present invention.

What is claimed is:

1. A switch device comprising:

a contact switch to perform electrical switching;

an operation axis attached to said contact switch such that rotation of said operation axis causes said contact switch to perform electrical switching;

a substantially disk-shaped operator attached to said operation axis such that rotation of said disk-shaped operator causes rotation of said operation axis, said substantially disk-shaped operator having a viewing portion;

light emitting elements arranged to illuminate said disk-shaped operator from below; and a substantially ring-shaped indicator, which does not rotate upon rotation of said substantially disk-shaped operator, having indications and being disposed between said light emitting elements and said viewing portion of said substantially disk-shaped operator, said substantially ring-shaped indicator including a right-hand side and a left-hand side;

wherein said viewing portion of said substantially disk-shaped operator is translucent and dark colored;

wherein said indications of said substantially ring-shaped indicator are translucent and other areas of said substantially ring-shaped indicator other than said indications are opaque;

wherein said indications are made difficult to identify through said viewing portion from above with no illumination of said light emitting elements;

wherein said indications are identified through said viewing portion only when said light emitting elements are turned on for illumination; and wherein said light-emitting elements are operably connected with said substantially disk-shaped operator such that, upon rotation of said substantially disk-shaped operator in one of a clockwise direction and a counter-clockwise direction, said light emitting elements are turned on beneath said right-hand side of said substantially ring-shaped indicator and turned off beneath said left-hand side of said substantially ring-shaped indicator and, upon rotation of said substantially disk-shaped operator in the other of the clockwise direction and the counter-clockwise direction, said light emitting elements are turned on beneath said left-hand side of said substantially ring-shaped indicator and turned off beneath said right-hand side of said substantially ring-shaped indicator.

2. The switch device of claim 1, wherein said contact switch, said operation axis and said substantially disk-shaped operator are configured and arranged such that downward pressing of said substantially disk-shaped operator causes electrical switching by said contact switch.

3. The switch device of claim 2, further comprising a cover covering said light emitting elements and said contact switch;

wherein said substantially ring-shaped indicator is attached to a top part of said cover.

4. The switch device of claim 3, further comprising a cylinder projecting downwardly from a bottom surface of said substantially disk-shaped operator;

wherein said operation axis is secured in said cylinder.

5. The switch device of claim 1, further comprising a cover covering said light emitting elements and said contact switch;

wherein said substantially ring-shaped indicator is attached to a top part of said cover.

6. The switch device of claim 5, further comprising a cylinder projecting downwardly from a bottom surface of said substantially disk-shaped operator;

wherein said operation axis is secured in said cylinder.

7. The switch device of claim 1, further comprising a cylinder projecting downwardly from a bottom surface of said substantially disk-shaped operator;

wherein said operation axis is secured in said cylinder.

8. The switch device of claim 1, wherein a cover is provided and covers said light emitting elements;

said ring-shaped indicator is attached on a top of said cover; and said cover includes one or more partitions between adjacent ones of said light emitting elements.

9. An input device comprising:

a switch device including a contact switch to perform electrical switching, an operation axis attached to said contact switch such that rotation of said operation axis causes said contact switch to perform electrical switching, a substantially disk-shaped operator attached to said operation axis such that rotation of said disk-shaped operator causes rotation of said operation axis, said substantially disk-shaped operator having a viewing portion, light emitting elements arranged to illuminate said disk-shaped operator from below, and a substantially ring-shaped indicator, which does not rotate upon rotation of said substantially disk-shaped operator, having indications and being disposed between said light emitting elements and said viewing portion of said substantially disk-shaped operator, said substantially ring-shaped indicator including a right-hand side and a left-hand side, wherein said viewing portion of said substantially disk-shaped operator is translucent and dark colored, wherein said indications of said substantially ring-shaped indicator are translucent and other areas of said substantially ring-shaped indicator other than said indications are opaque;

wherein said indications are made difficult to identify through said viewing portion from above with no illumination of said light emitting elements, wherein said indications are identified through said viewing portion only when said light emitting elements are turned on for illumination, and wherein said light-emitting elements are operably connected with said substantially disk-shaped operator such that, upon rotation of said substantially disk-shaped operator in one of a clockwise direction and a counter-clockwise direction, said light emitting elements are turned on beneath said right-hand side of said substantially ring-shaped indicator and turned off beneath said left-hand side of said substantially ring-shaped indicator and, upon rotation of said substantially disk-shaped operator in the other of the clockwise direction and the counter-clockwise direction, said light emitting elements are turned on beneath said left-hand side of said substantially ring-shaped indicator and turned off beneath said right-hand side of said substantially ring-shaped indicator; and a controller connected to said contact switch to turn said light emitting elements on and off according to electrical switching by said contact switch.

10. The input device of claim 9, wherein said contact switch, said operation axis and said substantially disk-shaped operator are configured and arranged such that downward pressing of said substantially disk-shaped operator causes electrical switching by said contact switch.

11. The input device of claim 10, wherein said switch device further comprises a cover covering said light emitting elements and said contact switch; and said substantially ring-shaped indicator is attached to a top part of said cover.

12. The input device of claim 11, wherein said switch device further comprises a cylinder projecting downwardly from a bottom surface of said substantially disk-shaped operator; and said operation axis is secured in said cylinder.

13. The input device of claim 9, wherein said switch device further comprises a cover covering said light emitting elements and said contact switch; and said substantially ring-shaped indicator is attached to a top part of said cover.

14. The input device of claim 13, wherein said switch device further comprises a cylinder projecting downwardly from a bottom surface of said substantially disk-shaped operator; and said operation axis is secured in said cylinder.

15. The input device of claim 9, wherein said switch device further comprises a cylinder projecting downwardly from a bottom surface of said substantially disk-shaped operator; and said operation axis is secured in said cylinder.

16. The input device of claim 9, further comprising a wiring board on which said light emitting elements and said contact switch are supported.

17. The input device of claim 9, wherein a cover is provided and covers said light emitting elements;

said ring-shaped indicator is attached on a top of said cover; and said cover includes one or more partitions between adjacent ones of said light emitting elements.

* * * * *